United States Patent [19]

Thompson et al.

[11] 4,136,515

[45] Jan. 30, 1979

[54] SEALED WATCH CASE AND METHOD OF MAKING

[75] Inventors: Harwell B. Thompson, Cheshire; William H. Young, Trumbull, both of Conn.

[73] Assignee: Timex Corporation, Waterbury, Conn.

[21] Appl. No.: 756,207

[22] Filed: Jan. 3, 1977

[51] Int. Cl.[2] ..... G04B 37/08; G04B 39/00; G10D 11/24

[52] U.S. Cl. ..... 58/90 R; 58/55; 58/88 R; 58/91; 73/431

[58] Field of Search ..... 58/88 R, 90 R, 91, 23–55, 58/58 R; 29/177–179; 73/431; 220/360; 206/18, 70

[56] References Cited

U.S. PATENT DOCUMENTS

| | | | |
|---|---|---|---|
| 2,187,863 | 1/1940 | More | 58/90 R |
| 2,350,651 | 6/1944 | Taubert et al. | 58/91 X |
| 3,020,703 | 2/1962 | Wardsworth | 58/90 R |
| 3,156,086 | 11/1964 | Egger | 58/90 R X |
| 3,828,549 | 8/1974 | Nozawa et al. | 58/90 R |

*Primary Examiner*—Edith S. Jackmon
*Attorney, Agent, or Firm*—William C. Crutcher

[57] ABSTRACT

A sealed watch case comprises an assembly wherein a gasket bead is applied to predetermined locations on the watch case and caseback prior to assembly. The gasket bead consists of a plastic or elastomeric material generally polymeric in nature which is applied in the form of a gasket bead to the crystal seat in the watch case, the caseback seat in the watch case or either predetermined locations in the caseback. The bead provides a fixed, formed in place and flexible gasket arrangement between the components of the watch case assembly to prevent entry of foreign matter into the watch case. The bead becomes an integral part of the watch case assembly, yet disassembly does not impair the effectiveness of the bead upon subsequent reassembly.

5 Claims, 6 Drawing Figures

SEALED WATCH CASE AND METHOD OF MAKING

BACKGROUND OF THE INVENTION

This invention relates to sealed watch cases and particularly to a new and improved sealed watch case and the method of making said watch case.

The prior art discloses various sealed and water-tight watch cases utilizing gaskets of various materials. In particular, U.S. Pat. No. 2,495,552 to O. Schmitz, which issued on Jan. 24, 1950, discloses the utilization of various packing rings to seal the back to a case band or the case itself as well as the bezel and crystal to the case and to each other. The patent specifically discloses the use of sealing rings to effect a water-tight seal between the various case components.

U.S. Pat. No. 3,156,086 to J. Egger which issued Nov. 10, 1964, discloses the utilization of an epoxy material which is applied in the form of a liquid or paste to seal a joint between the watch caseback and bezel. The material is applied to the location, the excess epoxy wiped off and then hardened in place with the application of heat. The utilization of formed-in-place seals permit greater flexibility in the tolerance of the bezel, the case, the back and the crystal. The patent specifically refers to an epoxy material either in liquid or paste form such as a metal glue. This would provide a permanent bond which would be destroyed on disassembly of the caseback and/or crystal.

In U.S. Pat. No. 2,187,863 to E. Morf, which issued Jan. 23, 1940, the invention involves a watch crystal for watertight watches wherein the crystal edges comprise a permanently soft synthetic resin material. The soft crystal edges are pressed between the bezel and case band to form a watertight joint.

The present invention, however, provides a sealed watch case wherein a bead of adherent resilient compressible elastomeric polymer or copolymer becomes an integral part of the watch case components. If the bead is laid down on the crystal seat, disassembly of the crystal for replacement due to scratches, cracking or breakage of the crystal does not impair the effectiveness of the bead when a new crystal is inserted. Furthermore, if the bead is laid down on the bezel in the caseback area or directly onto the caseback, it too becomes an integral part of either watch case component. Disassembly of the case back for any reason such as movement or repair does not affect the bead's functionality. Interchangeability of individual components is possible, i.e., the original assembly of crystal, watch case and caseback can be changed with components of identical configuration without losing effectiveness of the original seal.

SUMMARY OF THE INVENTION

The present invention pertains to a sealed watch case and a method of making said watch case. The invention comprises a watch case assembly including a crystal, watch case, and caseback which are mounted together to form a case assembly. A flexible single or multicomponent, plastic or elastomeric material such as urethane, epoxy, etc., in its natural state is applied in the form of a gasket bead to the crystal seat in the watch case, the caseback seat in the watch case, and/or the caseback in predetermined locations. The gasket beads are appropriately cured so that they are integral and adherent to the crystal seat, caseback seat, and/or caseback but nonadherent to mating parts of the watch case which will be brought into sealed contact therewith, and the parts then assembled together in such sealed contact so that the gasket material provides a fixed flexible gasket between the components of the watch case assembly. This seal is extremely effective and inexpensive to produce.

Accordingly, an object of this invention is to provide a new and improved sealed watch case.

Another object of this invention is to provide a new and improved method of producing sealed watch cases.

A further object of this invention is to provide a new and improved sealed watch case utilizing a formed-in-place flexible gasket of an elastomeric material applied in bead form to each component as necessary, which then becomes an integral part of the component.

BRIEF DESCRIPTION OF THE DRAWINGS

Other objects and advantages of this invention may be seen from the following description when viewed in conjunction with the accompanying drawings wherein.

DETAILED DESCRIPTION OF THE INVENTION

Figure 1:
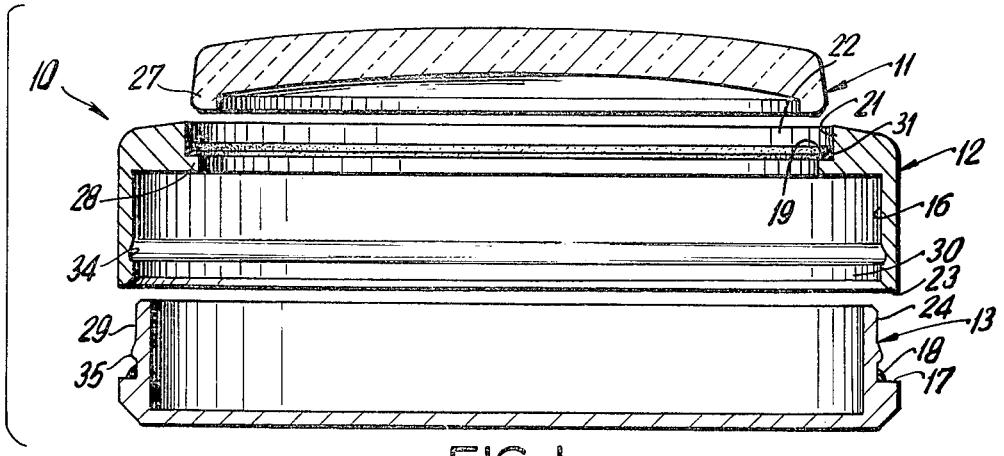
FIG. 1 is an exploded cross-sectional view of the watch case components showing an elastomeric material applied thereto.
Figure 2:
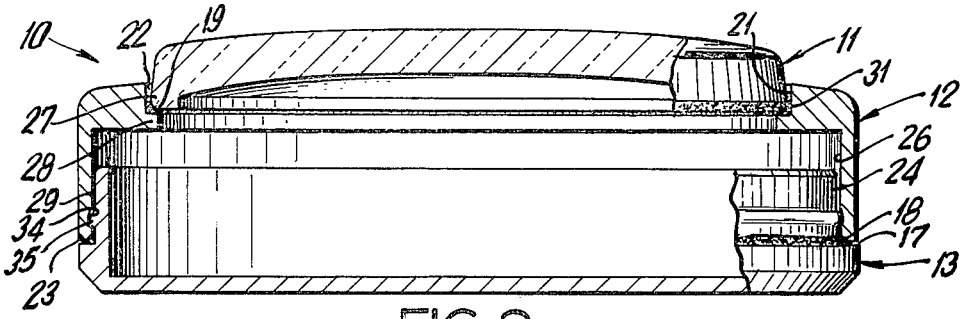
FIG. 2 is a partial cross-sectional view of the invention shown in FIG. 1 with the components assembled.

Referring to FIGS. 1 and 2 of the drawings, the invention comprises a sealed watch case 10 which comprises a crystal 11, a watch case 12, and a caseback 13. A first gasket bead 31 is applied to the crystal seat 19 and a second gasket bead 18 is applied at the juncture of the caseback wall 24 and the caseback seat 17. The beads 31 and 18 provide a fixed, formed-in-place and flexible gasket arrangement, after appropriate curing prior to assembly, between the components 11, 12 and 13 of the watch case assembly to prevent entry of foreign matter into the watch case 10. By appropriate curing prior to assembly, the beads 31 and 18 become an integral part of the components to which they are applied and provide effective sealing of the watch case assembly, and yet are not adherent to the crystal 11 and watch case 12, respectively, so that disassembly does not impair the effectiveness of these beads 31 and 18, when reassembly occurs. This is a considerable improvement over conventional techniques of relying upon a watch crystal to watch case fit, and a caseback to watch case fit presently employed on non-water resistant watches or the loose gasket arrangement such as O-rings which are used in water resistant watches to seal out foreign matter.

In the embodiment of FIGS. 1 and 2, it is noted that the bead 31 is readily applied to the crystal seat 19 so that a seal may be formed with the seat 19 and side wall 21 in the watch case 12 when the crystal 11 is positioned within the recess 22. The crystal 11 includes a downwardly projecting rim 27 which normally engages the circumferentially projecting seat portion 28 on the case 12. On the other hand, the bead 18 is applied at the juncture between the outwardly projecting seat 17 on the caseback 13 and the upwardly projecting rim 29. The gasket is effective, again after appropriate curing prior to assembly, when the caseback rim 29 is inserted into the aperture 30 in the watch case 12 with the base 23 engaging the bead on the seat 17 and the interior wall 26 forming a seal with the side wall 22.

Figure 3:
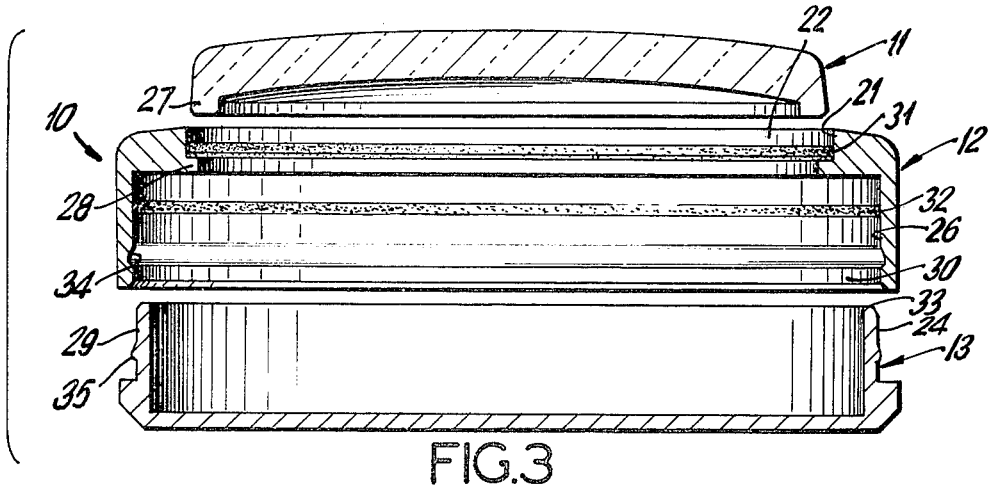
FIG. 3 is an exploded cross-sectional view of a second embodiment of the invention.
Figure 4:
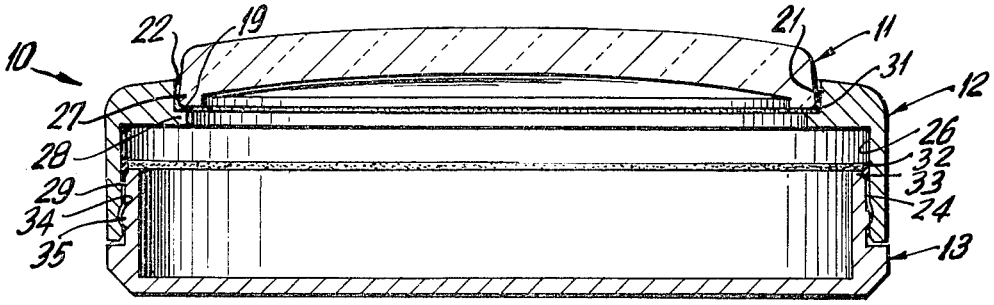
FIG. 4 is a cross-sectional view of the embodiment of FIG. 3 in an assembled condition.
Figure 5:
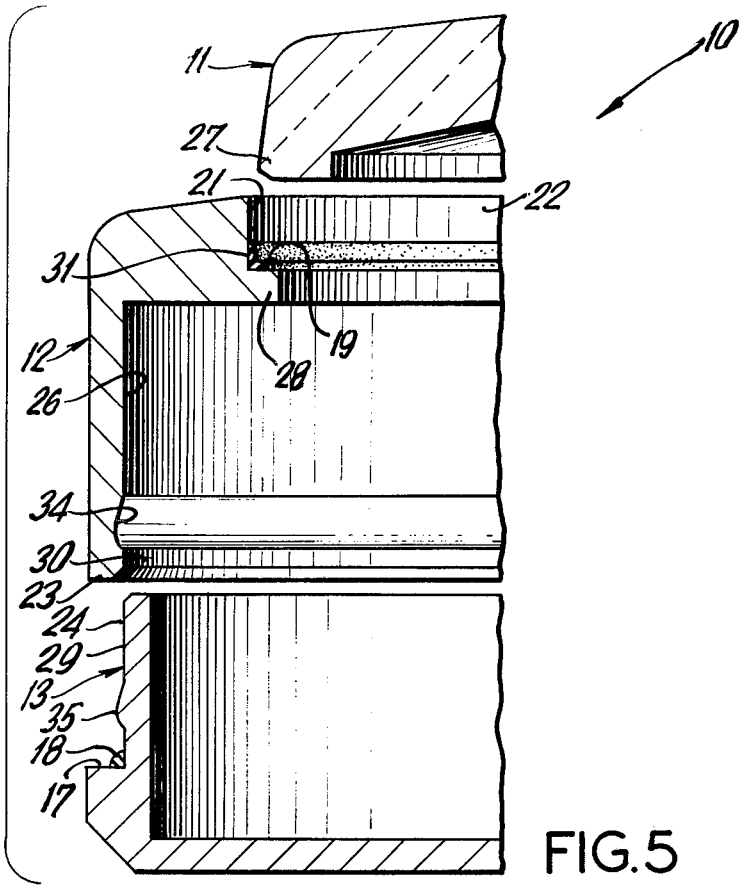
FIG. 5 is an enlarged and exploded cross section of a portion of FIG. 1.
Figure 6:
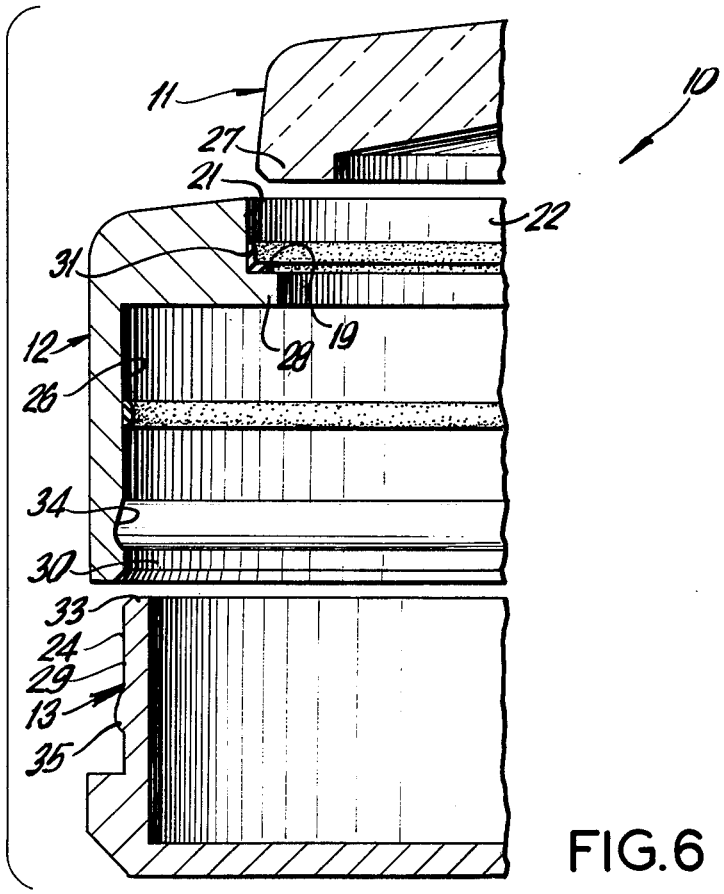
FIG. 6 is an enlarged and exploded cross section of a portion of FIG. 3.

In the embodiment of FIGS. 3 and 4, the same numbers are employed to indicate the components thereof since the structure of the watch crystal 11, watch case 12 and caseback 13 are identical. As before, the bead 31 is layed down along the crystal seat 19 and adjacent side wall portion 21 of the case 12. The bead 31 is of adherent, resilient, compressible elastomer so that disassembly of the crystal for replacement due to scratching, cracking or breaking does not impair the effectiveness of the bead 31 when a new crystal 11 is inserted.

A slightly different arrangement is used for the case to caseback seal. The caseback 13 has an adherent gasket seal applied as a bead 32 which is placed about the interior side wall 26 of the watch case 12 so that the upper portion 33 of the rim 29 contacts said bead 32 when the caseback 13 is inserted into the watch case 12. A seal is thereby formed by the head 32 when it is compressed by the mating part of the watch case assembly 10. The watch case 12 also includes a grooved portion 34 which is engaged by a protruding portion 35 on the caseback 13 to provide a snap-fit.

The bead material may be a flexible, single or multicomponent plastic or elastomeric material such as urethane, epoxy, etc. It may be applied in the form of a gasket bead to selected portions of the watch case assembly 10 and cured thereon to become a permanent part of the selected component. It is selected to be adherent to the component in its non-cured as well as cured state and non-adherent to another mating part of the watch case after curing when the other part is brought into sealed contact therewith. The bead thickness and width may be varied depending upon the design of the watch case and its assembly. The beads 18, 31 and 32 shown in the various embodiments provide a formed-in-place and flexible gasket arrangement which seals the watch case assembly 10 and becomes an integral part of the selected watch case component so that disassembly or repair of the assembly 10 does not adversely effect the seal, even after reassembly of components.

While the invention has been explained by a detailed description of certain specific embodiments, it is understood that various modifications and substitutions can be made in any of them within the scope of the appended claims which are intended also to include equivalents of such embodiments.

What is claimed is:

1. A sealed watch case assembly comprising:

a watch case member including an upper body portion having downwardly extending peripheral side walls, a first recess extended axially within the upper body portion and second axial recess in the watch case formed by the peripheral side wall, said upper body portion having an inwardly projecting ledge portion forming a crystal seat;

a crystal having an upper surface to enclose the first recess in the watch case and downwardly projecting side wall portions to engage said seat;

a first resilient gasket bead applied to said crystal seat and adapted to receive the downwardly projecting sidewall portions of the crystal to effect sealing action, said first bead being applied to said seat as an uncured elastomeric bead and then being cured in situ prior to assembly so that it is integral and adherent to said seat but nonadherent to the sidewall portions of said crystal when brought into sealed relation therewith during assembly;

a caseback member having a base and upwardly extending peripheral walls for insertion into the second recess in the watch case and having an exterior seat portion protruding outwardly from the walls to receive the downwardly extending side walls of the watch case, and;

a second resilient gasket bead applied to at least one of the case member and caseback member to provide a seal therebetween, said second bead being applied to said one of said members as an uncured elastomeric bead and then being cured in situ prior to assembly so that it is integral and adherent to said one of said members but nonadherent to said other member when placed in sealed relation therewith during assembly;

whereby the nonadherence of said first and second gasket beads to said crystal and other member enables the watch case to be disassembled for repair and the like and then reassembled without impairing the sealing effectiveness of said gasket beads.

2. The method of making a sealed watch case assembly comprising the steps of:

providing a watch case having an upper body portion with a first recess therein and an inwardly protruding crystal seat portion at the base of said recess, and downwardly extending side walls forming a second recess;

providing a crystal having an upper surface and a downwardly extending rim portion;

applying a first bead of uncured elastomeric material to the crystal seat;

providing a caseback having a base and upwardly extending side walls having an exterior seat portion protruding outwardly therefrom;

applying a second bead of uncured elastomeric material to interior of the watch case sidewalls;

causing the first and second beads to cure in place so that said first and second beads are integral and adherent to said crystal seat and said watch case sidewall, respectively, but nonadherent to said crystal rim portion and said caseback side walls, respectively, when brought into sealed relation by the following assembly steps of:

inserting the crystal into the first recess so that the rim portion of the crystal engages the first cured bead and;

inserting the caseback into the second recess in the case so that the caseback side walls engage the second cured bead;

whereby the nonadherence of said first and second gasket beads to said crystal rim portion and caseback sidewalls, respectively, enables disassembly of the watch case for repair and the like and then reassembly without impairing the sealing effectiveness of said gasket beads.

3. A sealed watch case assembly in accordance with claim 1 wherein:

said second gasket bead is applied to the exterior seat portion on the caseback member at a point where the bead may be engaged by the downwardly extending side walls of the watch case member.

4. A sealed watch case assembly in accordance with claim 1 wherein:

the second gasket bead is applied about the interior of the side walls on the watch case member at a point wherein the bead may be engaged by the upper portion of the caseback member walls when the caseback is inserted into the case.

5. A sealed watch case assembly in accordance with claim 1 further including:

a circumferentially grooved portion on the interior watch case walls and a protruding portion on the exterior caseback walls to engage said grooved portion in a snap fit.

* * * * *